United States Patent [19]

Luehring

[11] Patent Number: 4,527,028

[45] Date of Patent: Jul. 2, 1985

[54] MODULAR VACUUM INTERRUPTER

[75] Inventor: Elmer L. Luehring, Cleveland Heights, Ohio

[73] Assignee: Joslyn Mfg. and Supply Co., Chicago, Ill.

[21] Appl. No.: 625,047

[22] Filed: Jun. 27, 1984

[51] Int. Cl.[3] ..... H01H 33/66

[52] U.S. Cl. ..... 200/144 B; 200/294

[58] Field of Search ..... 200/144 B, 293, 294, 200/296

[56] References Cited

U.S. PATENT DOCUMENTS 3,143,627 8/1964 Kiesel et al. ..... 200/294

4,479,042 10/1984 Basnett ..... 200/144 B

*Primary Examiner*—Robert S. Macon

*Attorney, Agent, or Firm*—Mason, Kolehmainen, Rathburn & Wyss

[57] ABSTRACT

A modular vacuum interrupter for controlling the application of single or polyphase electrical power to single or polyphase electrical apparatus includes a rigid base, a plurality of identical vacuum switch modules, an operating mechanism and cover. The base includes a pair of inclined surfaces that define a pair of tracks for capturing and retaining the plurality of vacuum switch modules and the cover therebetween and in contact with the base. Each of the vacuum switch modules includes first and second electrical terminals, an enclosed vacuum switch having a pair of electrical contacts in an evacuated environment, an operating plunger for moving contact into engagement with a stationary contact, a return spring for biasing the operating plunger and vacuum contacts to an OPEN position, a movable flexible shunt for electrically interconnecting the first terminal to the movable contact and an internally threaded insulating cap for isolating the vacuum switches mounted in adjacent vacuum switch modules. The operating mechanism includes a rotatable operating shaft mechanically interconnected with each operating plunger in each switch module for placing the pairs of contacts simultaneously in their CLOSED positions. The operating mechanism also includes solenoids for initiating the rotational movement of the operating shaft. The cover includes a plurality of integrally formed, nubs configured to be engaged by a notch formed at the lower edge of each cap for interconnecting the base, switch modules, operating mechanism and the cover to form a unitary vacuum interrupter.

20 Claims, 9 Drawing Figures

MODULAR VACUUM INTERRUPTER

BACKGROUND OF THE INVENTION

1. Field of the Invention

The present invention generally relates to a new and improved device for controlling the application of single or polyphase electrical power to electrical apparatus and, more specifically, to a new and improved modular vacuum interrupter or switch for controlling the application of three phase electrical power to a three phase motor.

2. Description of the Prior Art

Devices for switching single or polyphase, typically three phase, electrical power to low voltage electrical apparatus, for example, a three-phase motor, are old and well known in the prior art. Air magnetic switches as well as vacuum switches have been used for this purpose. These prior art switches are typically mechanically complex and are costly and time-consuming to assemble or disassemble. Hardware, such as nuts, bolts, screws, washers and similar fasteners, is typically used in abundance to assemble and maintain such switches as unitary structures. A need exists in the art for relatively inexpensive and simple single and polyphase vacuum interrupters or switches that may be easily and quickly assembled and disassembled without the need for the hardware typically used in the prior art devices. In order to reduce inventory requirements, a need also exists for modular components to enable the same vacuum switch module to be used in a single phase vacuum interrupter or in a polyphase vacuum interrupter.

SUMMARY OF THE INVENTION

An object of the present invention is to provide a new and improved vacuum interrupter or switch for controlling the application of single or polyphase electrical power to electrical apparatus.

Another object of the present invention is to provide a new and improved modular vacuum interrupter or switch for controlling the application of single or polyphase electrical power to electrical apparatus in which the same basic vacuum switch module may be used in either a single phase vacuum interrupter or, by mechanically interconnecting in parallel a plurality of identical vacuum switch modules, in a polyphase vacuum interrupter.

Another object of the present invention is to provide a new and improved modular vacuum interrupter or switch for controlling the application of single or polyphase electrical power to electrical apparatus that can be assembled without the use of hardware, such as nuts, bolts, screws, washers and similar fasteners.

Briefly, the present invention is directed to a new and improved modular vacuum interrupter or switch for controlling the application of single or polyphase (for example, three phase) electrical power to single or polyphase electrical apparatus, for example, a three phase motor. The vacuum interrupter includes an elongated rigid base, a plurality of identical vacuum switch modules, an operating mechanism and an elongated insulating cover.

The base includes a pair of first and second, elongated, inclined, raised surfaces spaced apart along an upper surface of the base in order to capture and retain the plurality of vacuum switch modules and the elongated cover therebetween. Each of the first and second inclined raised surfaces is formed at an acute angle with respect to the planar surface of the base. The intersection of each of the first and second surfaces with the upper surface of the base forms first and second spaced apart grooves or tracks for receiving and retaining generally complementarily shaped portions of the plurality of vacuum switch modules and the elongated cover therebetween.

Each of the vacuum switch modules includes first and second spaced apart electrical terminals, an enclosed vacuum switch having a pair of electrical vacuum contacts disposed in an evacuated environment, an operating plunger for moving a movable one of the vacuum contacts into contact with the other stationary vacuum contact, a return spring for biasing the operating plunger and the vacuum contacts to an OPEN position, a movable flexible electrical shunt for electrically interconnecting the first terminal to the movable vacuum contact and an elongated, internally threaded insulating cap for electrically isolating the vacuum switches mounted in adjacent vacuum switch modules.

The operating mechanism includes an elongated, rigid, rotatable, grooved, operating shaft mechanically interconnected to all of the vacuum switch modules for placing the pairs of vacuum contacts simultaneously in their CLOSED positions. The operating mechanism also includes one or more solenoids for initiating the rotational movement of the operating shaft to place the pairs of vacuum contacts in their CLOSED positions. Each solenoid includes a stator fixedly secured in the elongated insulating cover and an armature movable within the stator upon the energization of the stator. One or more elongated rigid coupling pins mechanically interconnect the one or more armatures to the operating shaft. One end portion of each coupling pin is received within an aperture formed through the exposed or outward end of the armature and an oppositely disposed elongated end portion extends through a complementarily shaped aperture formed through the operating mechanism. In this manner, each pin is captured between each armature and the operating shaft resulting in the conversion of the translational movement of each armature into the pivotable movement of each elongated pin and the resultant rotational movement of the operating shaft. The elongated groove formed along the operating shaft mechanically engages a complementarily shaped, laterally extending tooth formed along the outer surface of each operating plunger to cause each plunger to be driven upwardly against the bias of each return spring to place the pairs of vacuum contacts in their CLOSED positions.

The insulating cover includes an elongated lip that is received within one of the first and second tracks of the base to retain the vacuum switch modules, the base and the insulating cover mechanically connected as a unitary vacuum interrupter. The insulating cover also includes a plurality of integrally formed, upwardly extending protuberances or nubs, at least one physically exposed adjacent to each vacuum switch module. Each insulating cap includes a notch formed along its lower edge that is complementarily shaped to the nubs on the insulating cover for capturing one of the nubs upon the complete threaded engagement of the insulating cap with the housing of one of the vacuum switch modules. In this manner, the base, the vacuum switch modules, the operating mechanism and the cover are easily and rapidly removably interconnected to form a unitary vacuum interrrupter without the use of tools or hardware, such as nuts, bolts, screws, washers and similar fasteners, typically associated with prior art devices.

BRIEF DESCRIPTION OF THE DRAWING

The above and other objects and advantages and novel features of the present invention will become apparent from the following detailed description of a preferred embodiment of the present invention illustrated in the accompanying drawing wherein.

DETAILED DESCRIPTION OF THE PREFERRED EMBODIMENT

Figure 1:
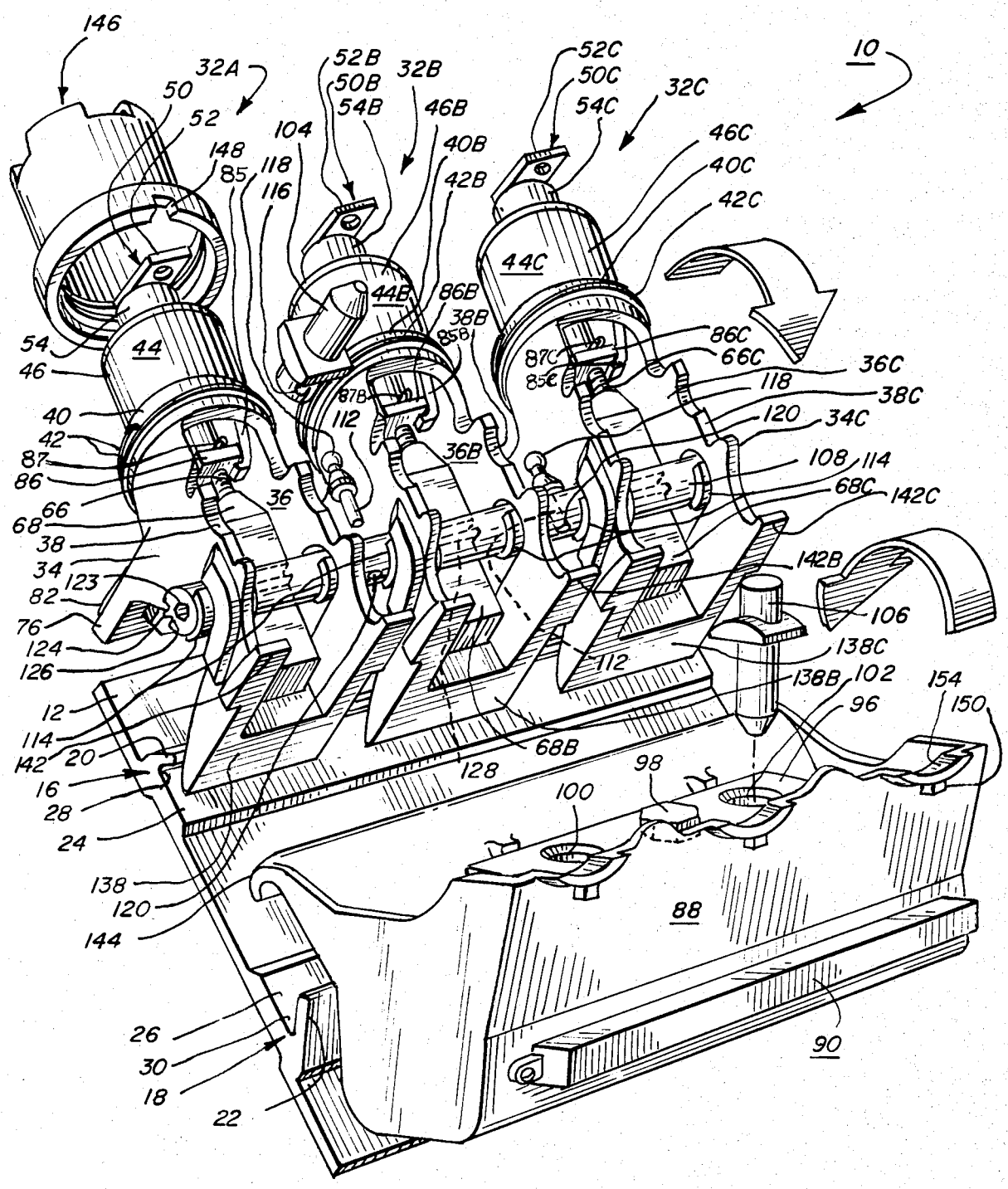
FIG. 1 is an exploded, perspective view of a modular vacuum interrupter constructed in accordance with the principles of the present invention and depicted in a partially assembled condition.

Referring to the drawing, there is illustrated a new and improved modular polyphase, specifically three phase, vacuum interrupter 10 for controlling the application of polyphase electrical power to electrical apparatus, such as a three phase electrical motor. The vacuum interrupter 10 includes an elongated rigid base 12 preferably formed from extruded metal, a plurality of identical vacuum switch modules 32A, 32B and 32C, an operating mechanism and an elongated insulating cover 88.

The base 12 includes a plurality of notches or apertures 14 for receiving a plurality of fasteners (not illustrated) to mount the vacuum interrupter 10 in any desired location. The base 12 also includes a pair of first and second, spaced apart grooves or tracks 16 and 18 respectively formed between and defined by first and second elongated, inclined raised surfaces or flanges 20 and 22 that respectively intersect first and second laterally extending surfaces 24 and 26 of the base 12 at acute angles. A pair of gaps 28 and 30 defined by the flanges 20 and 22 and the surfaces 24 and 26 receive edge portions of the plurality of vacuum switch modules 32A, 32B and 32C and of the insulating cover 88, thereby retaining those components of the vacuum interrupter 10 in contact with the base 12 in an assembled condition.

The vacuum switch modules 32A, 32B and 32C are identical and are serially disposed along the base 12 for operation in unison as a three phase vacuum interrupter 10. Components of the vacuum switch modules 32B and 32C that are identical to components of the vacuum switch module 32A are depicted in the drawing with the same reference numerals as the corresponding components of vacuum switch module 32A along with a suffix (B) or (C) respectively to identify components of the vacuum switch modules 32B and 32C.

The vacuum switch module 32A includes a module housing 34 formed from rigid insulating material, such as structural foam plastic or a glass fiber filled thermoplastic resin. The module housing 34 includes an internal cavity 36 and an exposed side 38 providing access to the internal cavity 36. The modular housing 34 also includes a collar 40 formed at its upper end with a plurality of threads 42 disposed about its outer periphery. A conventional vacuum switch 44 extends above the collar 40 and includes a ceramic vacuum switch housing 46 that circumscribes an evacuated interior 48 (FIG. 8).

The vacuum switch module 32A includes a first external apertured electrical terminal 50 for interconnection with a power lead (not illustrated) connected to one phase of a three phase power source. The terminal 50 includes a terminal bar or conductive member 52 secured to a support member 54 mounted to the top of the ceramic vacuum switch housing 46.

Figure 7A:
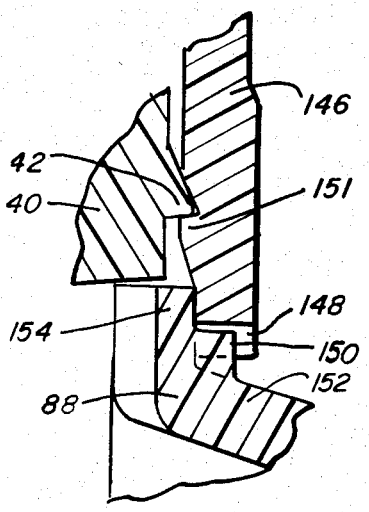
FIG. 7A is a fragmentary or detail view of a portion of the device of FIG. 7, depicting the interconnection of the insulating cover to the insulating cap and housing of a vacuum switch module.
Figure 7:
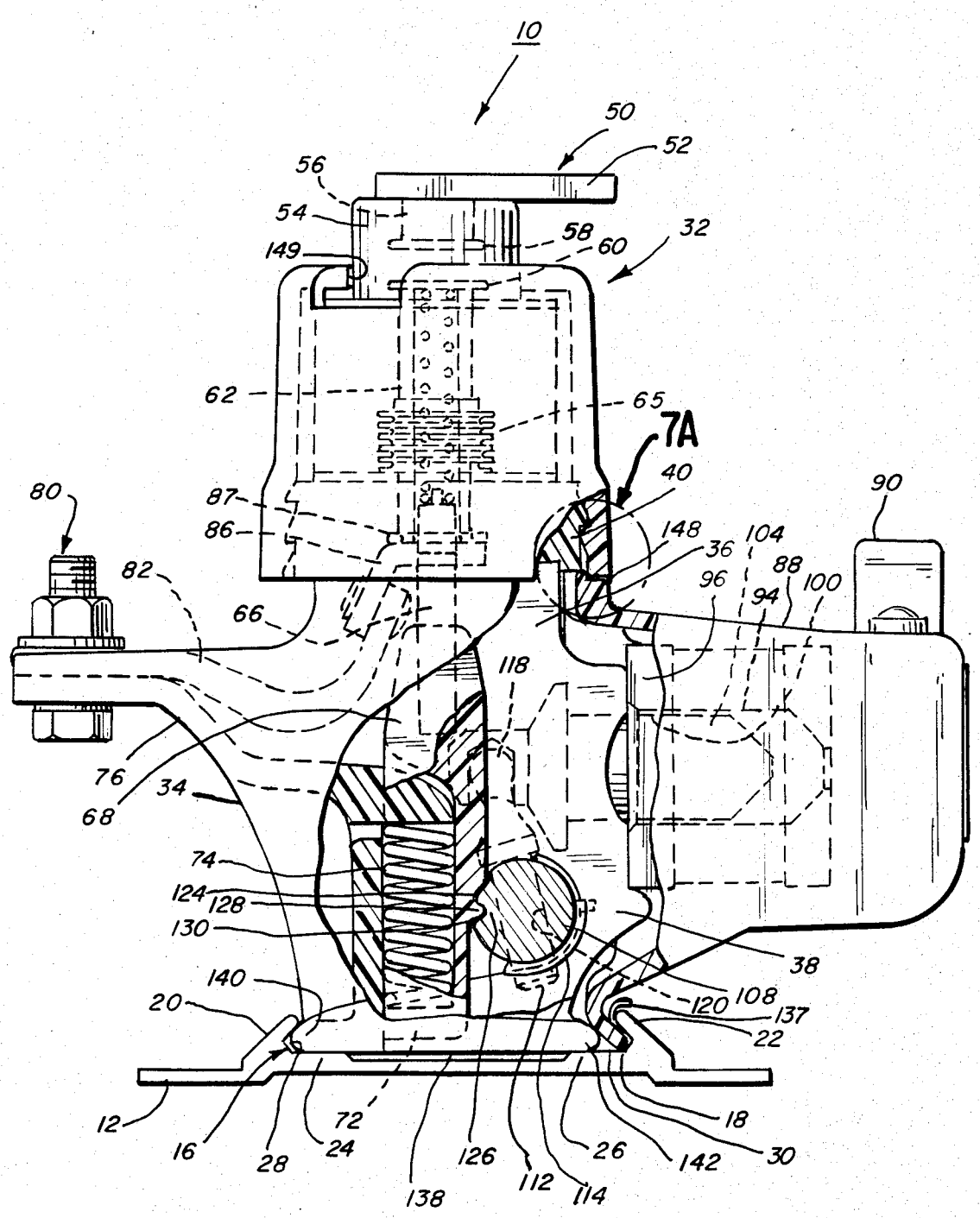
FIG. 7 is a partially cut away, end elevational view of the device of FIGS. 1 and 4 in its OPEN position.
Figure 8:
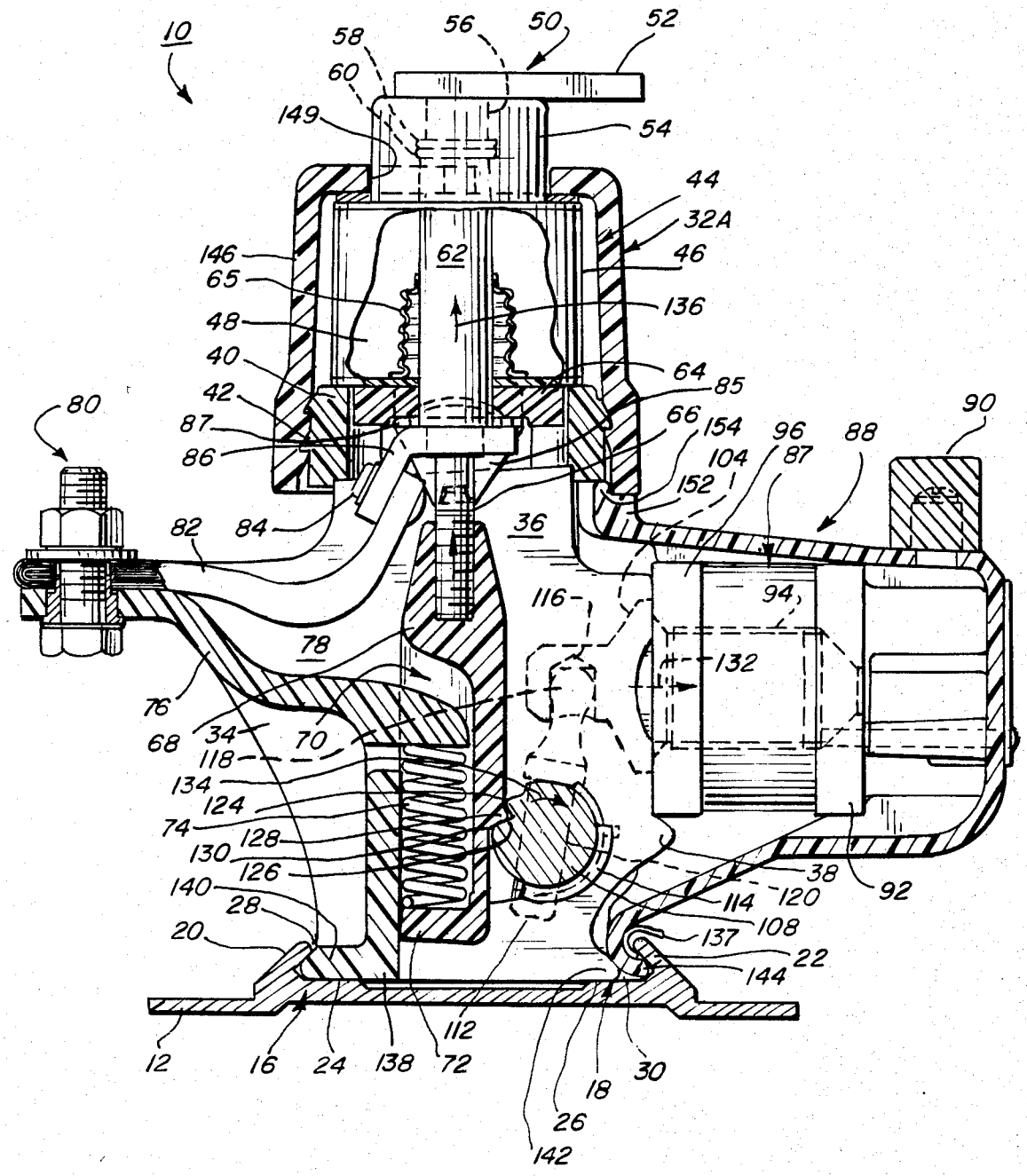
FIG. 8 is a view similar to FIG. 7 depicting the device of FIGS. 1 and 4 in its CLOSED position.

The internal components of the vacuum switch 48 are conventional, per se, and are depicted in FIGS. 7 and 8 in illustrative form only for the purpose of explaining the principles of the present invention. The terminal 52 is mechanically and electrically connected to one longitudinal end of an elongated conductive stationary contact stem 56. Fixedly secured to the opposite longitudinal end of the contact stem 56 is a stationary contact 58. A movable contact 60 for engagement with the contact 58 is disposed within the cavity 48 and is mounted at one longitudinal end of an elongated conductive movable contact stem 62. The stem 62 extends externally of the cavity 48 through an apertured guide bushing 64. A movable longitudinal end of a conventional bellows 65 is fixedly secured to and sealed to the stem 62 below the contact 60; and a fixed longitudinal end of the bellows 65 is secured to and sealed to a flange brazed to the metalized ceramic housing 46, thereby maintaining the evacuated environment or vacuum within the cavity 48.

The stem 62 includes an elongated threaded drive pin 66 that is received within and threadedly engages an elongated operating plunger 68, preferably formed from a rigid insulating material. The operating plunger 68 includes an elongated cavity 70 extending above a lower edge or shelf 72 of the operating plunger 68. A return spring 74 is positioned in the cavity 70 and is compressed between the shelf 72 and a rigid interior surface of the module housing 34. The return spring 74 thereby biases the operating plunger 68 to its position depicted in FIG. 7 corresponding to an OPEN position of the engageable contacts 58 and 60.

The module housing 34 includes an extension or surface 76 that defines the lower portion of a cavity 78. Disposed at the outward end of the extension 76 is a second external electrical terminal 80 for receipt of a power lead to connect the terminal 80 and the vacuum interrupter 10 to one pole or phase of a polyphase electrical apparatus. The terminal 80 is electrically connected to the movable contact stem 66 by a movable, flexible, electrical shunt or cable 82 formed, for example, from copper. The shunt or cable 82 extends into the cavity 78 and is connected electrically and mechanically by a fastener 84 to a conductive bracket 86 that in turn is mechanically and electrically fixedly secured to the movable contact stem 62 by means of brazing.

When the contacts 58 and 60 are in their OPEN position (FIG. 7), the terminal 50 is electrically isolated from the terminal 80. When the contacts 58 and 60 are in their CLOSED position (FIG. 8) the terminal 50 is electrically short circuited to the terminal 80.

The vacuum interrupter 10 may be placed in its CLOSED position (FIG. 8) by the energization of a pair of solenoids 87 mounted in the elongated insulating cover 88. The solenoids are energized by an external source of electrical power through contacts (not illustrated) disposed along a conventional terminal strip 90 mounted on the cover 88. Each solenoid 87 includes a liner sleeve 94 mounted between a pair of pole pieces 92 and 96. The pieces 92 and 96 are secured to each other in the cover 88 by a conventional fastener 98.

A pair of apertures 100 and 102 through the pole piece 96 enables a pair of armatures 104 and 106 to be received within the liner sleeves 94 when the solenoids 87 are energized. The translational movement of the armatures 104 and 106 enables the rotational movement of an elongated rigid rotatable grooved operating shaft 108 through a pair of rigid coupling pins 110 and 112 that are mechanically connected to and captured between the armatures 104 and 106 and the operating shaft 108. The operating shaft 108 extends through each of the module housings 34 and rotates on a plurality of bearings 114.

Each of the armatures 104 and 106 includes at its outermost end an aperture for the receipt of a generally rounded head 118 on each of the coupling pins 110 and 112. The operating shaft 108 includes a plurality of elongated apertures 120 through which the elongated end portions of the coupling pins 110 and 112 extend. A hexagonally configured aperture 123 formed at one end of the operating shaft 108 enables a tool to be inserted therein to manually rotate the operating shaft 108 during servicing or testing. An elongated tooth 124 and an elongated slot 126 formed along the length of the operating shaft 108 engage complementarily shaped laterally extending grooves or slots 130 and teeth 128 formed in each operating plunger 68 to establish a driving connection between the operating plungers 68 and the operating shaft 108. Thus, energization of the solenoids 87 (FIG. 8) attracts the armatures 104 and 106 into the liner sleeves 94 as depicted by the arrow 132 (FIG. 8) resulting in the clockwise rotation of the operating shaft 108 as depicted by the arrow 134. Clockwise rotation of the operating shaft results in the upward movement of the operating plungers 68 in the direction of arrow 136 and the closure of the contacts 58 and 60. In this manner, a short circuit electrical path is established between the terminals 50 and 80.

Figure 2:
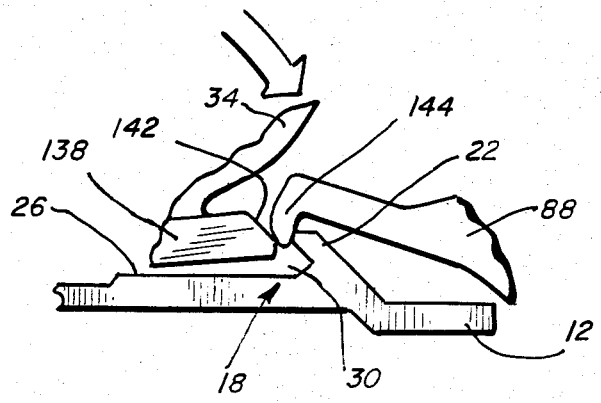
FIG. 2 is a fragmentary or detail view of a portion of the base, the insulating cover and the vacuum switch module of the device of FIG. 1, depicting these components during their assembly.
Figure 3:
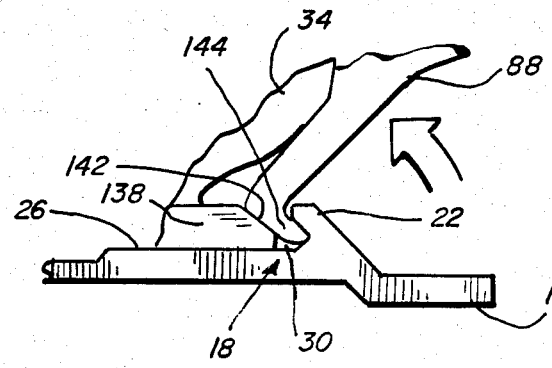
FIG. 3 is a view similar to FIG. 2 illustrating the components of FIG. 2 in their assembled condition.
Figure 4:
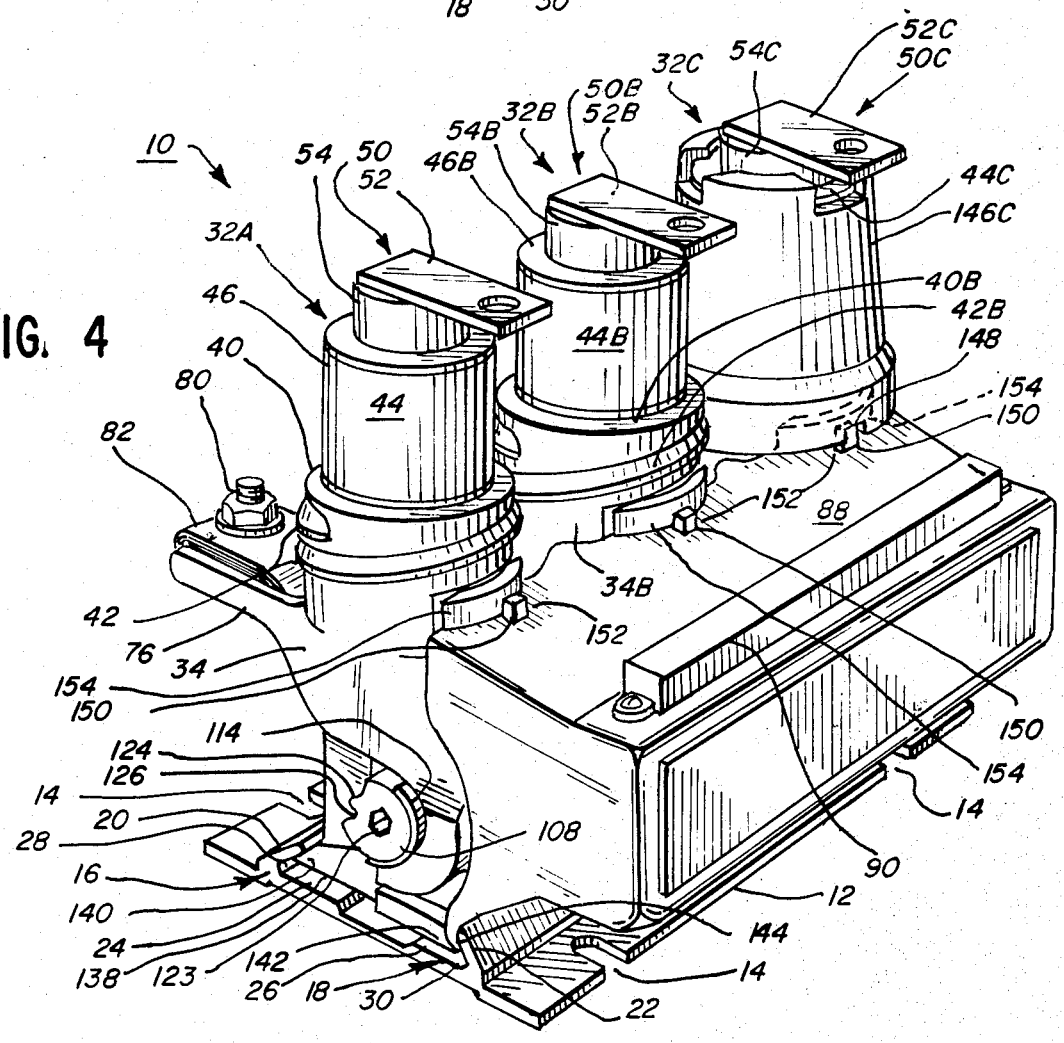
FIG. 4 is a perspective view of the device of FIG. 1 in a partly assembled condition.
Figure 5:
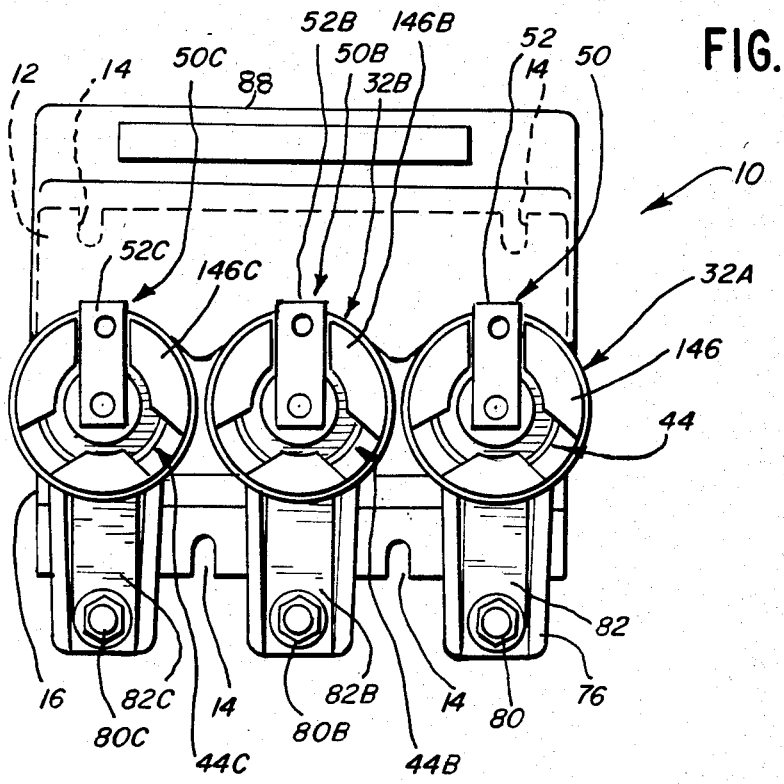
FIG. 5 is a top plan view of the device of FIGS. 1 and 4.
Figure 6:
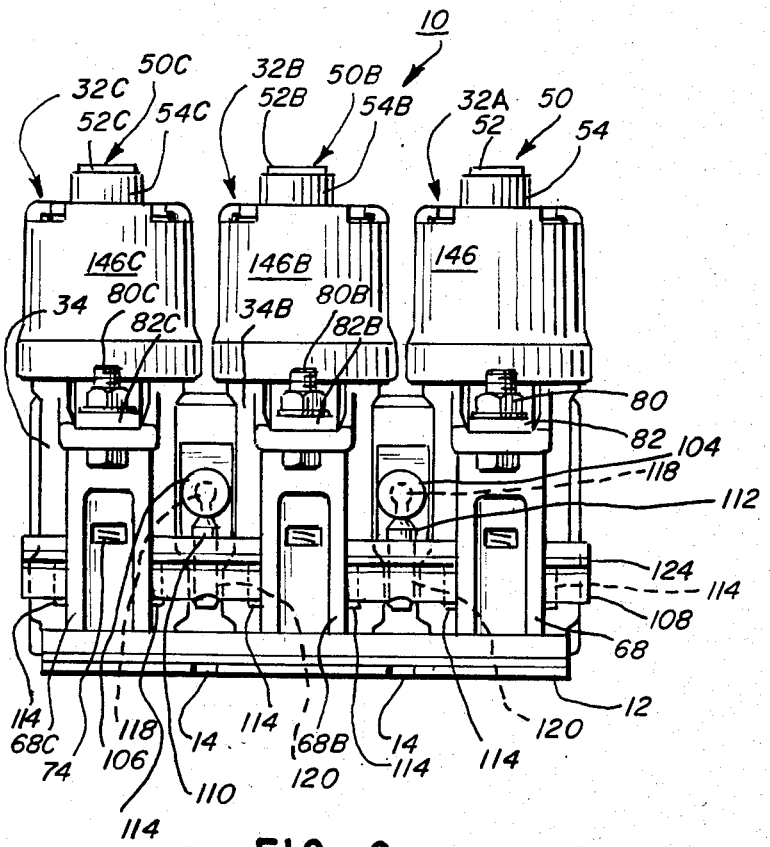
FIG. 6 is a front, elevational view of the device of FIGS. 1 and 4.

As illustrated in FIGS. 1 through 4, the modular vacuum interrupter 10 may be assembled without tools and without the use of hardware, such as nuts, bolts, screws, washers and similar fasteners, typically associated with prior art devices. The module housing 34 includes a base 138 with a first elongated lip or edge 140 (FIG. 4). Initially, after the operating shaft 108 has been inserted through each module housing 34 into driving engagement with each operating plunger 68, the edge 140 of the housing 34 is positioned along the track 16. The base 138 also includes a pair of lips or edges 142 for disposition near the track 18. As depicted in FIGS. 2 and 3, the insulating cover 88 also includes an elongated lip or edge 144 that is configured to be received in the gap between the edges 142 and the track 18 or flange 22.

The vacuum switch modules 32A, 32B and 32C are secured to the base 12 by pivoting the vacuum switch modules 32A, 32B and 32C to the orientation depicted in FIG. 1 with the edges 140 disposed in and along the track 16. The vacuum switch modules 32A, 32B and 32C are then pivoted to the position depicted in FIG. 2 for engagement with the edge 144 of the insulating cover 88. The vacuum switch modules 32A, 32B, 32C then are moved to the positions depicted in FIGS. 3 and 4, in which positions the edges 140, 142 and 144 are captured in and between the tracks 16 and 18. If desired, a ground wire 137 (FIGS. 7 and 8) may be positioned in and along the track 18 between the edge 144 and the flange 22 for electrically grounding the magnet pole pieces to the base 12.

To complete the assembly of the vacuum interrupter 10, a plurality of elongated, internally threaded insulating caps 146 fabricated from structural foam plastic or from a thermoplastic resin are used to interconnect the vacuum switch modules 32A, 32B and 32C to the insulating cover 88. Each insulating cap 146 includes a plurality of three, spaced apart radially extending slots that extend radially outwardly from the center of the top of the insulating cap 146 to enable the receipt of each insulating cap 146 over the electrical terminal 50 and the support 54. A plurality of threads 151 formed upon the lower interior surface of each insulating cap 146 are configured to threadedly engage the threads 42. When the insulating cap 146 is threaded onto the collar 40, adjacent vacuum switches 44 are electrically isolated from each other.

Each insulating cap 146 includes a notch 148 formed along its lower periphery for releasably lockingly engaging one of a plurality of upstanding protuberances or nubs 150 extending above the surface 152 of the insulating cover 88. A plurality of generally arcuately shaped capture walls 154 also extend above the surface 152 for disposition and for capture within one of the insulating caps 146. To complete the assembly of the vacuum interrupter 10, each insulating cap 146 is threaded on one of the collars 40 until the notch 148 flexes over and captures one of the nubs 150, in which position the wall 154 is internally disposed within and against the interior surface of the insulating cap 146. In this manner, the vacuum interrupter 10 may be easily and rapidly assembled and disassembled without tools and without the use of hardware, such as nuts, bolts, screws, washers and similar fasteners, typically associated with prior art devices.

Many modifications and variations of the present invention are possible in light of the above teachings. For example, while a three phase vacuum interrupter 10 is depicted in FIGS. 1 through 8 and is specifically described hereinabove, it should be appreciated that the principles of the present invention are equally applicable to single phase vacuum interrupters and to polyphase vacuum interrupters having multiple phases or poles, other than three phases or poles. Specifically, by shortening the base 12, the operating shaft 108 and the insulating cover 88 and by removing two of the three vacuum switch modules 32, the vacuum interrupter 10 can be easily modified to provide a single phase vacuum interrupter. In such an instance, only one of the two solenoids 87 may be required to rotate the operating shaft. Similarly, by lengthening the base 12, the operating shaft 108 and the insulating cover 88 and by adding one or more additional vacuum switch modules 32, a polyphase vacuum interrupter having a number of phases or poles greater than three can be provided. The basic or individual vacuum switch module 32, however, can be utilized in either single or polyphase vacuum interrupters, thereby significantly reducing the inventory requirements of a manufacturer or assembler of single or polyphase vacuum interrupters constructed in accordance with the principles of the present invention. Thus, it is to be understood that, within the scope of the appended claims, the invention may be practiced otherwise than as specifically described hereinabove.

What is claimed and desired to be secured by Letters Patent is:

1. A modular vacuum interrupter for controlling the application of electrical power to electrical apparatus comprising a base, a vacuum switch module having an insulating housing and a vacuum switch mounted on said housing, said vacuum switch including a pair of contacts capable of being placed in an OPEN position or in a CLOSED position, operating means for placing said pair of contacts in said CLOSED position, an insulating cover for at least a portion of said operating means and hardwareless means for removably interconnecting said vacuum switch module, said cover and said base to form a modular vacuum interrupter.

2. A modular vacuum interrupter as recited in claim 1 wherein said hardwareless means comprises an elongated insulating cap for receipt over said vacuum switch.

3. A modular vacuum interrupter as recited in claim 1 wherein said vacuum switch module includes an elongated operating plunger fixedly secured to a movable contact of said pair of contacts and mounted for reciprocation in said housing, said vacuum switch module further including biasing means disposed in said housing in engagement with said plunger for biasing said pair of contacts to said OPEN position.

4. A modular vacuum interrupter as recited in claim 3 wherein said operating means includes a solenoid mounted in said cover and an elongated, rigid rotatable operating shaft mounted for rotation in said housing, said solenoid including an elongated armature, said operating means further including coupling means for interconnecting said armature and said shaft such that a translational movement of said armature effects a rotational movement of said shaft, said shaft including means for mechanically interconnecting said shaft to said plunger for moving said plunger and compressing said biasing means in response to the rotational movement of said shaft.

5. A modular vacuum interrupter as recited in claim 1 wherein said hardwareless means includes an elongated insulating cap threadably secured to said vacuum switch module, said cap including a notch, said cover including a nub, said notch being positioned over said nub to capture said nub therein.

6. A modular vacuum interrupter as recited in claim 1 further comprising second and third vacuum switch modules removably mounted on said base, said second and third vacuum switch modules each being substantially identical to said first mentioned vacuum switch module.

7. A modular vacuum interrupter as recited in claim 6 wherein said operating means includes an elongated, rigid, rotatable, operating shaft mounted for rotation in said housing of each of said first mentioned, second and third vacuum switch modules and means for rotating said shaft to place simultaneously said pair of contacts in each of said first mentioned, second and third vacuum switch modules in said CLOSED position.

8. A modular polyphase vacuum interrupter for controlling the application of polyphase electrical power to polyphase electrical apparatus comprising an elongated base, a plurality of substantially identical vacuum switch modules, each of said vacuum switch modules including an insulating housing, a vacuum switch secured to said housing, first and second spaced apart electrical terminals, a stationary contact electrically short circuited to said first terminal, a movable contact electrically short circuited to said second terminal, an elongated member mechanically and electrically connected to said movable contact and mounted for translational movement in said housing and means biasing said elongated member to a first position in which said stationary contact is spaced from said movable contact such that said vacuum switch is in an OPEN position, an elongated, rigid, rotatable operating shaft, said plurality of vacuum switch modules being disposed along the length of said shaft and receiving said shaft therethrough, means for mechanically interconnecting said shaft to said elongated member in each of said plurality of vacuum switch modules to effect the translational movement of said elongated member upon the rotational movement of said shaft such that said movable contact is moved into engagement with said stationary contact to place said vacuum switch in a CLOSED position, an elongated insulating cover, actuating means at least partially mounted in said cover for effecting the rotational movement of said shaft, and means for mechanically interconnecting said actuating means to said shaft.

9. A modular polyphase vacuum interrupter as recited in claim 8 wherein said base includes first and second spaced apart inclined portions extending above said base and forming acute angles with said base, edge portions of each of said plurality of vacuum switch modules being disposed in and captured between said first and second inclined portions.

10. A modular polyphase vacuum interrupter as recited in claim 8 wherein said biasing means comprises an elongated compression spring, a first longitudinal end of said compression spring being in contact with said housing and a second longitudinal end of said compression spring being in contact with said elongated member.

11. A modular polyphase vacuum interrupter as recited in claim 8 wherein each of said plurality of vacuum switch modules further includes an elongated insulating cap threadedly secured to said housing.

12. A modular polyphase vacuum interrupter as recited in claim 11 wherein each said cap includes a first integrally formed means for engaging a plurality of second means integrally formed on said cover and complementarily shaped to said first integrally formed means for lockingly engaging said first integrally formed means.

13. A modular polyphase vacuum interrupter as recited in claim 8 wherein said base comprises integrally formed means for receiving a portion of said cover and for retaining said portion of said cover in contact with said base and each said plurality of vacuum switch modules.

14. A modular polyphase vacuum interrupter for controlling the application of polyphase electrical power to a polyphase electrical motor comprising an elongated base, first, second and third substantially identical vacuum switch modules removably mounted on said base, each of said first, second and third vacuum switch modules including an insulating housing, a vacuum switch disposed on said housing, first and second electrical terminals, a stationary and movable contact in said vacuum switch, an elongated contact stem at least partially disposed in said vacuum switch mechanically and electrically connecting said stationary contact to said first terminal, an elongated movable member mechanically and electrically connected to said movable contact, a flexible current carrying conductive shunt mechanically and electrically connecting said elongated member to said second terminal, an operating plunger mounted in said housing for translational movement and mechanically connected to said elongated member and a compression spring disposed between said plunger and said housing for biasing said plunger into a position in which said stationary contact and said movable contact are out of engagement, an elongated, rigid, rotatable operating shaft extending through said first, second and third vacuum switch modules and mounted for rotation therein, said operating shaft being mechanically interconnected with said plunger in each of said first, second and third vacuum switch modules to effect the simultaneous translational movement of said plunger in each of said first, second and third modules upon the rotational movement of said operating shaft, a solenoid and means for mechanically interconnecting said solenoid to said operating shaft to effect the rotational movement of said operating shaft upon the energization of said solenoid, thereby moving said movable contact into engagement with said stationary contact simultaneously in said first, second and third vacuum switch modules.

15. A modular polyphase vacuum interrupter as recited in claim 14 further comprising an elongated insulating cover, at least a portion of said solenoid being mounted within said insulating cover, said insulating cover being in contact with said first, second and third modules and said base.

16. A modular polyphase vacuum interrupter as recited in claim 15 wherein said cover includes a plurality of integrally formed protrusions extending outwardly from a surface of said cover.

17. A modular polyphase vacuum interrupter as recited in claim 16 wherein each of said vacuum switch modules further includes an insulating cap for electrically isolating the vacuum switch of one of said vacuum switch modules from an adjacent vacuum switch of another of said vacuum switch modules.

18. A modular polyphase vacuum interrupter as recited in claim 17 wherein said insulating cap includes integrally formed means for releasably lockingly engaging at least one of said projections extending from said surface of said cover.

19. A method of assembling a modular polyphase vacuum interrupter for controlling the application of polyphase electrical power to polyphase electrical apparatus comprising the steps of selecting a first vacuum switch module, selecting a second vacuum switch module substantially identical to said first vacuum switch module, selecting a third vacuum switch module substantially identical to said first and second vacuum switch modules, disposing said first, second and third vacuum switch modules serially along the length of an elongated, rigid, rotatable operating shaft, disposing said first, second and third vacuum switch modules along the length of and in contact with an elongated rigid base, disposing an elongated insulating cover in contact with said first, second and third vacuum switch modules and said base and interconnecting said first, second and third modules and said insulating cover and said base as a unitary modular polyphase vacuum interrupter by disposing at least one elongated insulating cap over at least a portion of one of said first, second and third vacuum switch modules.

20. A method of assembling a modular polyphase vacuum interrupter as recited in claim 19 wherein said interconnecting step comprises the step of disposing an elongated insulating cap over a portion of each one of said first, second and third vacuum switch modules and in contact with both said insulating cover and said first, second and third vacuum switch modules.

* * * * *